US006687380B1

(12) United States Patent
Vishwamitra

(10) Patent No.: US 6,687,380 B1
(45) Date of Patent: Feb. 3, 2004

(54) ACTIVE SUB-WOOFER SPEAKER SYSTEM

(75) Inventor: Tejaswi Vishwamitra, Cincinnati, OH (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 09/466,487

(22) Filed: Dec. 17, 1999

(51) Int. Cl.[7] ..... H04R 1/02
(52) U.S. Cl. ..... 381/386; 381/87; 181/150
(58) Field of Search ..... 381/120, 386, 381/395, 87; 330/251, 207 A; 181/150

(56) References Cited

U.S. PATENT DOCUMENTS

| | | | | | |
|---|---|---|---|---|---|
| 4,296,280 | A | * | 10/1981 | Richie | |
| 4,390,813 | A | * | 6/1983 | Stanley | 315/248 |
| 4,592,087 | A | | 5/1986 | Killion | 381/68 |
| 4,689,819 | A | | 8/1987 | Killion | 381/68 |
| 4,903,300 | A | * | 2/1990 | Polk | |
| 4,924,963 | A | * | 5/1990 | Polk | 181/141 |
| 5,097,513 | A | | 3/1992 | Jordan et al. | 381/160 |
| 5,164,991 | A | * | 11/1992 | Johnson et al. | 330/297 |
| 5,306,986 | A | | 4/1994 | Siao | 315/248 |
| 5,313,524 | A | | 5/1994 | Van Hulle et al. | 381/105 |
| 5,317,640 | A | | 5/1994 | Callias | 381/68.4 |
| 5,410,592 | A | | 4/1995 | Wagner et al. | 379/388 |
| 5,729,175 | A | | 3/1998 | Ferrer | 330/10 |
| 5,815,581 | A | * | 9/1998 | Andersson | 330/251 |
| 6,229,388 | B1 | * | 5/2001 | Nalbant | 330/10 |

* cited by examiner

*Primary Examiner*—Forester W. Isen
*Assistant Examiner*—Brian T. Pendleton
(74) *Attorney, Agent, or Firm*—Michael Best & Friedrich LLP

(57) ABSTRACT

A powered or active sub-woofer speaker system includes a power supply circuit, an audio amplifier circuit and a sub-woofer audio driver. The power supply circuit includes a toroidal power transformer to supply power to the audio amplifier circuit. The amplifier circuit includes a class-D audio amplifier adapted to amplify signals received from an audio source and to couple them to the sub-woofer audio driver. Each of the power supply circuit, audio amplifier circuit and sub-woofer audio driver has a low profile to permit the sub-woofer speaker system to be mounted in a closely confined space such as a house wall cavity.

18 Claims, 2 Drawing Sheets

ACTIVE SUB-WOOFER SPEAKER SYSTEM

FIELD OF THE INVENTION

The present invention relates generally to amplified speakers and, more particularly to an active sub-woofer speaker system.

BACKGROUND OF THE INVENTION

Sub-woofer speaker systems are designed to reproduce the lowest bass frequencies in music and sound, such as audio frequencies below 35 Hz. These low frequencies cannot be reproduced by conventional smaller woofers so larger audio drivers or speakers cones having a diameter of ten (10) inches or more are typically used in sub-woofer speaker systems. Sub-woofers are typically used with stereo amplifiers or home entertainment systems to give an enhanced, realistic listening experience in which these lower frequencies can be heard and felt by the listener.

Sub-woofers are designed to be either powered or passive. In the powered or active variety, the sub-woofer system has a built-in power amplifier to drive the sub-woofer speaker. Typically, sub-woofer systems have the power amplifier and its associated power supply mounted directly on or within the enclosure of the speaker system. Powered sub-woofers typically find use in applications where a local amplifier of a stereo or home entertainment system is limited in its output power and cannot drive the sub-woofer to its full efficiency. The powered sub-woofers therefore increase the capability of the local audio source amplifier by providing remote amplification of audio signals generated by the audio source through the use of the built-in power-supply and amplifier at the speaker.

Passive sub-woofers, on the other hand, do not have built-in power supplies or amplifiers, but rather rely on the amplifier of the audio source to drive the sub-woofer audio driver. Therefore, passive sub-woofers are generally not able to produce the same sound level as powered sub-woofers due to the limited output power of most conventional stereo amplifiers.

Typically, powered or active sub-woofers include a class-AB audio power amplifier to drive the speaker. However, class-AB audio amplifiers generally have a relatively low efficiency so a significant amount of input power to the amplifier is wasted as heat. Massive aluminum heat sinks are therefore used to keep the class-AB audio amplifier cool which leads to increased size, weight and cost of such amplifiers. Additionally, powered or active sub-woofer speaker systems typically use conventional E-I laminated transformers as a power supply to drive the audio amplifier. However, E-I laminated transformers tend to be relatively large due to their relative inefficiency and therefore preclude the use of conventionally powered sub-woofer speaker systems in closely confined spaces such as a house wall cavity.

Therefore, there is a need for an active or powered sub-woofer that is adapted to be readily mounted in a closely confined space for reproducing low frequency audio information from an audio source.

SUMMARY OF THE INVENTION

The present invention overcomes the foregoing and other shortcomings and drawbacks of sub-woofer speaker systems heretofore known. While the invention will be described in connection with certain embodiments, it will be understood that the invention is not limited to these embodiments. On the contrary, the invention includes all alternatives, modifications and equivalents as may be included within the spirit and scope of the present invention.

The sub-woofer speaker system of the present invention is designed to be mounted in a closely confined space such as a house wall cavity, ceiling, floor or other low profile enclosure. In accordance with the principles of the present invention, the active sub-woofer speaker system includes a power supply circuit, an audio amplifier circuit powered by the power supply circuit, and a sub-woofer audio driver that is driven by the audio amplifier circuit. Low frequency audio signals are coupled from an audio source, such as a stereo amplifier or home entertainment system, to the audio amplifier circuit of the sub-woofer speaker system. The audio signals are amplified by the audio amplifier and coupled to the sub-woofer audio driver for reproduction of the low frequency audio information within a listening area. The sub-woofer audio driver preferably has a diameter of about ten (10) inches to give an enhanced, realistic listening experience to the listener.

The power supply circuit of the sub-woofer speaker system includes a toroidal power transformer coupled to a rectifier and filter circuit. The toroidal power transformer typically has a minimum efficiency of about 90%, and negligible leakage inductance and stray capacitance. Due to its relatively high efficiency, the toroidal power transformer is significantly smaller than conventional E-I laminated transformers.

The audio amplifier circuit includes an audio preamplifier circuit having an audio input adapted to be coupled to the audio signal source and an audio output coupled to a class-D audio amplifier. The class-D audio amplifier typically has a minimum efficiency of about 90%. Due to its relatively high efficiency and minimal heat loss, the class-D power amplifier is significantly smaller and lighter than conventional class-AB audio amplifiers. Each of the audio preamplifier circuit and class-D audio amplifier circuit is coupled to the rectifier and filter circuit for receiving DC power therefrom. A sub-woofer audio driver is coupled to an audio output of the class-D amplifier and is operable to produce low frequency audio information in response to audio signals coupled to the preamplifier circuit from the audio source. Preferably, the power supply circuit, audio amplifier circuit and the sub-woofer audio driver have a low profile, such as a depth of less than about four (4) inches, so the sub-woofer speaker system may be readily mounted in a closely confined space such as a house wall cavity, floor, ceiling or other low profile enclosure.

It will be appreciated that the minimum 90% efficiency of the toroidal power transformer with its negligible leakage inductance and stray capacitance permits a smaller power transformer to be used in the sub-woofer speaker system of the present invention over the conventional E-I laminated power transformers of the past. Moreover, it will also be appreciated that the minimum 90% efficiency of the digital class-D audio amplifier with its minimal heat loss permits a smaller and lighter audio amplifier to be used in the sub-woofer speaker system of the present invention over the conventional class-AB audio amplifiers of the past. The combination of the toroidal power transformer, class-D audio amplifier and sub-woofer audio driver, each having a low profile of less than about four (4) inches, permits the sub-woofer speaker system of the present invention to be readily mounted in a closely confined space for reproducing low frequency audio information from an audio source.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
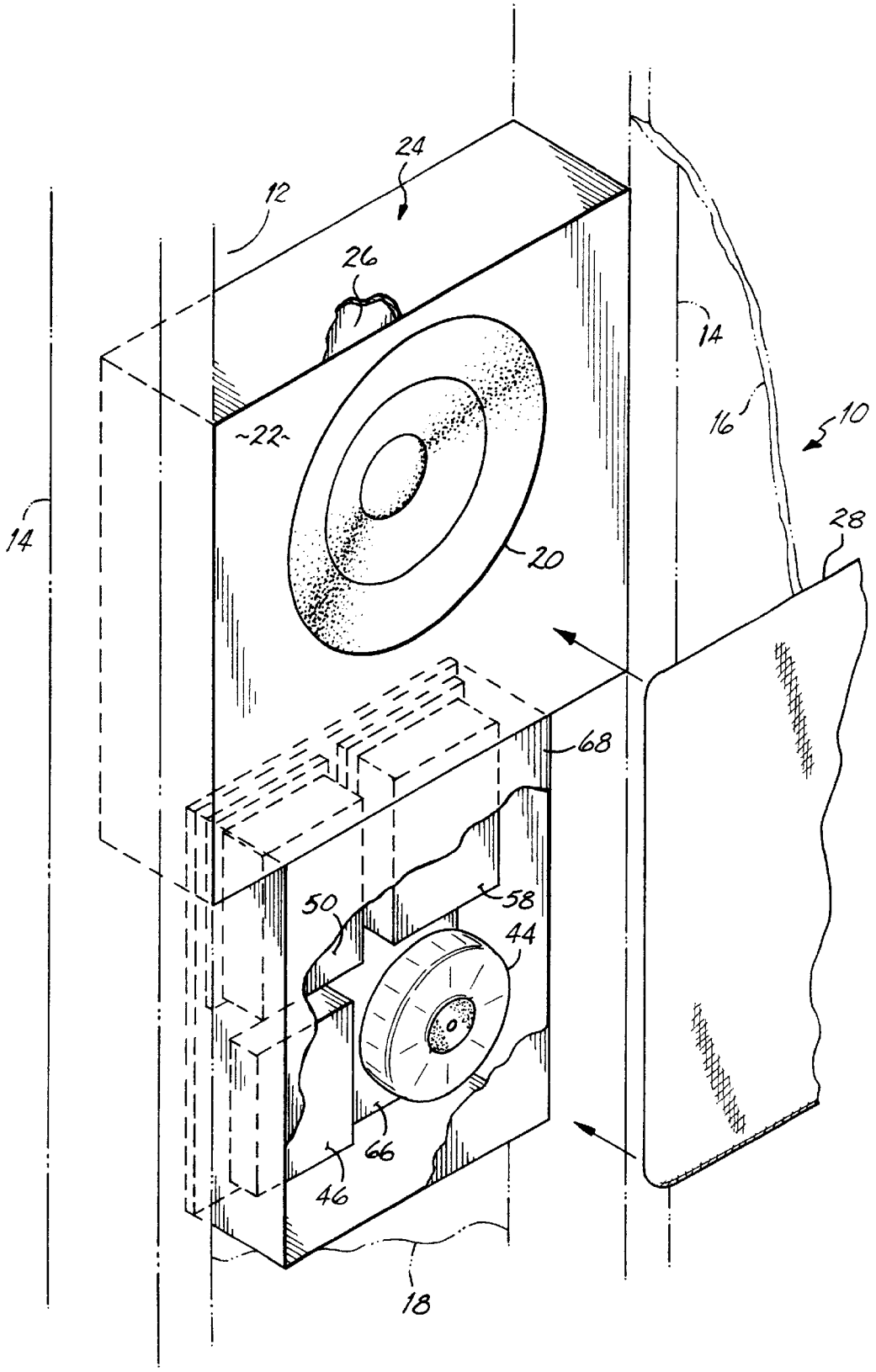
FIG. 1 is a perspective view of an active sub-woofer speaker system in accordance with the principles of the present invention illustrating mounting of the speaker system in a wall.

With reference to the figures, an active sub-woofer speaker system 10 is shown in accordance with the principles of the present invention. As will be described in more detail below, sub-woofer speaker system 10 is constructed to be installed in a closely confined space such as a house wall cavity 12 that is defined by a pair of vertical studs 14, a front partition 16 facing the listening area, and a rear partition 18 spaced from the front partition 16.

Sub-woofer speaker 10 preferably includes an audio driver or speaker cone 20 having a diameter of at least ten (10) inches that is mounted to a baffle 22 through a conventional basket (not shown). An enclosure 24 is mounted on the rear side of the baffle 22 so that a forward side of the speaker cone 20 is in contact with air outside of the enclosure 24, while a specific volume of air is enclosed within a chamber 26 formed by the enclosure 24 on the rear side of the speaker cone 20. Alternatively, the enclosure 24 could be used only as a mounting frame to mount the sub-woofer audio driver 20 and support its associated amplifier and power supply components. In this case, the air inside the entire wall cavity between a pair of adjacent vertical studs 14 will provide the necessary volume of air on the rear side of speaker cone 20. While not shown, it will be appreciated that suitable mounting hardware is provided to mount the baffle 22, audio driver 20 and enclosure 24 to the pair of vertical studs 14 so that the sub-woofer speaker 10 is securely mounted in the wall cavity 12. A mesh grill 28 is provided to cover the sub-woofer speaker 10 after it has been mounted in the wall cavity 12 to provide an aesthetic appearance or finish to the speaker.

Figure 2:
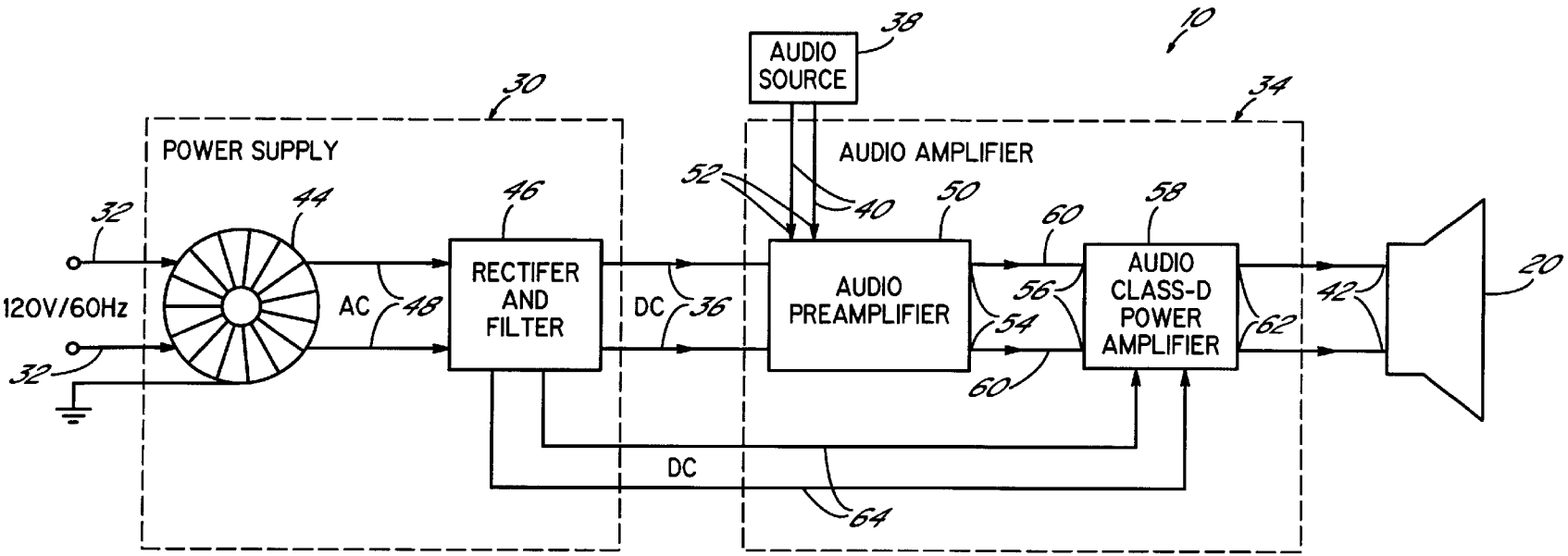
FIG. 2 is a schematic of the speaker system shown in FIG. 1.

As shown in FIG. 2, sub-woofer speaker system 10 includes a power supply circuit 30 that has a power input electrically coupled to 120V AC line power through AC power leads 32, and a power output electrically coupled to an audio amplifier circuit 34 through DC power leads 36. The audio amplifier circuit 34 is adapted to be electrically coupled to an audio source 38, such as a stereo amplifier or home theater system, to receive audio signals generated by the audio source 38 through leads 40. The audio amplifier circuit 34 is further electrically coupled to the sub-woofer audio driver 20 through leads 42 to reproduce the audio signals received from the audio source 38.

More particularly, power supply circuit 30 preferably includes a toroidal power transformer 44 having a toroidal magnetic core (not shown), a primary winding on the core coupled to the 120V AC line power through the AC power leads 32, and a secondary winding on the core coupled to an enclosed DC power supply or rectifier and filter circuit 46 through AC power leads 48. A suitable toroidal power transformer 44 is commercially available from Plitron Manufacturing Inc. of Toronto, Canada as Model No. 7178-B1-01. A suitable rectifier and filter circuit 46 is commercially available from NuTone Inc. of Cincinnati, Ohio, assignee of the present invention, as Model No. 26PB3.

Audio amplifier circuit 34 preferably includes an enclosed audio preamplifier circuit 50 having an audio input 52 adapted to receive audio signals from the audio source 38 through the leads 40. An audio output 54 of the audio amplifier circuit 50 is electrically coupled to an audio input 56 of an enclosed digital class-D audio amplifier 58 through leads 60. A suitable audio preamplifier circuit 50 is commercially available from NuTone Inc. as Model No. 26PB4. A suitable digital class-D audio amplifier 58 is commercially available from NuTone Inc. as Model No. 26PB13. The class-D audio amplifier 58 has an audio output 62 that is coupled to the sub-woofer audio driver 20 through the leads 42. The rectifier and filter circuit 46 is operable to electrically couple DC power to the audio preamplifier circuit 50 through the DC power leads 36. The rectifier and filter circuit 46 also is operable to electrically couple DC power to the digital class-D audio amplifier 58 through DC power leads 64.

As shown in FIG. 1, each of the toroidal power transformer 44, rectifier and filter 46, audio preamplifier circuit 50 and digital class-D audio amplifier 58 are mounted on a generally planar support member 66. An inner enclosure (not shown) and an outer enclosure 68 are supported in the wall cavity 12 to enclose the assembly of components 44, 46, 50 and 58. While not shown, it will be appreciated that suitable mounting hardware is provided to support the assembly of components 44, 46, 50 and 58 within the wall cavity 12.

In use, sub-woofer speaker system 10 is mounted within a confined space such as the wall cavity 12 though the mounting hardware (not shown). The toroidal power transformer 44 is electrically coupled to 120V AC line power through the AC power lines 32, and the audio source 38 is electrically coupled to the audio preamplifier circuit 50 through leads 40. Audio signals coupled to the audio preamplifier circuit 50 are coupled to the audio input 56 of the digital class-D audio amplifier 58 through leads 60. The class-D audio amplifier 58 applies amplified audio signals at its audio output 62 to the sub-woofer audio driver 20 through leads 42. In this way, low frequency audio information is reproduced by the sub-woofer audio driver 20 from the audio signals received from the audio source 38 on leads 40.

It will be appreciated that while the sub-woofer speaker system 10 is shown mounted in wall cavity 12, in other embodiments of the present invention, the sub-woofer speaker system 10 may be mounted in a speaker enclosure (not shown), a ceiling (not shown) or a floor (not shown) as will be appreciated by those skilled in the art. As shown in FIG. 1, each of the toroidal power transformer 44, rectifier and filter 46, audio preamplifier circuit 50 and digital class-D audio amplifier 58 preferably have a shallow depth preferably less than four (4) inches, and more preferably less than three and one-half (3.50) inches. Additionally, the sub-woofer audio driver 20 preferably has a shallow depth preferably less than four (4) inches, and more preferably less than three and one-half (3.50) inches. In this way, the active sub-woofer system 10 may be easily mounted in confined spaces such as the house wall cavity 12 to free up floor space within the listening area.

It will be appreciated that the minimum 90% efficiency of the toroidal power transformer 44 with its negligible leakage inductance and stray capacitance permits a smaller power transformer to be used in sub-woofer speaker system. Moreover, it will also be appreciated that the minimum 90% efficiency of the digital class-D audio amplifier 58 with its minimal heat loss permits a smaller and lighter audio amplifier to be used. The combination of the toroidal power transformer 44, class-D audio amplifier 58 and sub-woofer audio driver 20, each having a low profile of less than about four (4) inches, permits the sub-woofer speaker system 10 of the present invention to be readily mounted in a closely confined space for reproducing low frequency audio information from audio source 38.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, I claim:

1. A modular active sub-woofer speaker system adapted for recess into a wall having a plurality of studs, the modular active sub-woofer speaker system comprising:

a first housing mounted to at least one of the plurality of studs and recessed within the wall, the first housing including a power supply circuit, and an audio amplifier circuit including a class-D audio amplifier coupled to said power supply circuit for receiving power therefrom and adapted to be coupled to a source of audio signals; and a second housing mounted to at least one of the plurality of studs and recessed within the wall, the second housing including a sub-woofer audio driver coupled to said audio amplifier circuit and operable to produce sound in response to said audio signals coupled to said class-D amplifier.

2. The sub-woofer speaker system of claim 1 wherein said power supply circuit includes a power transformer coupled to a rectifier and filter circuit.

3. The sub-woofer speaker system of claim 2 wherein said power transformer comprises a toroidal power transformer.

4. The sub-woofer speaker system of claim 1 wherein said audio amplifier circuit includes an audio preamplifier circuit having an audio input adapted to be coupled to said audio signals and an audio output coupled to said class-D audio amplifier.

5. The sub-woofer speaker system of claim 1 wherein said sub-woofer audio driver has a diameter of about ten inches.

6. The sub-woofer speaker system of claim 1 wherein said power supply circuit and said audio amplifier circuit have a depth of less than about four inches.

7. The sub-woofer speaker system of claim 6 wherein said sub-woofer audio driver has a depth of less than about four inches.

8. The system as claimed in claim 1, wherein said second housing includes a plate that partially covers said sub-woofer audio driver and said plate protrudes from the wall.

9. A modular active sub-woofer speaker system adapted for recess into a wall having a plurality of studs, the modular active sub-woofer speaker system comprising:

a first housing mounted to a wall stud and recessed within the wall, the first housing including a power supply circuit having a toroidal power transformer coupled to a rectifier and filter circuit, and an audio amplifier circuit including a class-D audio amplifier coupled to said rectifier and filter circuit for receiving power therefrom and adapted to be coupled to a source of audio signals; and a second housing mounted to said wall stud and recessed within the wall, the second housing mounted adjacent to the first housing, the second housing including a sub-woofer audio driver coupled to said audio amplifier circuit and operable to produce sound in response to said audio signals coupled to said class-D amplifier.

10. The sub-woofer speaker system of claim 9 wherein said audio amplifier circuit includes an audio preamplifier circuit having an audio input adapted to be coupled to said audio signals and an audio output coupled to said class-D audio amplifier.

11. The sub-woofer speaker system of claim 10 wherein said audio preamplifier circuit is coupled to said rectifier and filter circuit for receiving power therefrom.

12. The sub-woofer speaker system of claim 9 wherein said sub-woofer audio driver has a diameter of about ten inches.

13. The sub-woofer speaker system of claim 9 wherein said power supply circuit and said audio amplifier circuit have a depth of less than about four inches.

14. The sub-woofer speaker system of claim 13 wherein said sub-woofer audio driver has a depth of less than about four inches.

15. A modular active sub-woofer speaker system adapted for recess into a wall having a plurality of studs, the modular active sub-woofer speaker system comprising:

a first housing mounted to a wall stud and recessed within the wall, the first housing including a power supply circuit having a toroidal power transformer coupled to a rectifier and filter circuit, and an audio amplifier circuit including an audio preamplifier circuit having an audio input adapted to be coupled to a source of audio signals and an audio output coupled to a class-D audio amplifier, each of said audio preamplifier circuit and said class-D audio amplifier being coupled to said rectifier and filter circuit for receiving power therefrom; and a second housing mounted to said wall stud and recessed within the wall, the second housing mounted adjacent to the first housing, the second housing including a sub-woofer audio driver coupled to said audio output of said class-D audio amplifier and operable to produce sound in response to said audio signals coupled to said audio preamplifier circuit.

16. The sub-woofer speaker system of claim 15 wherein said sub-woofer audio driver has a diameter of about ten inches.

17. The sub-woofer speaker system of claim 15 wherein said power supply circuit and said audio amplifier circuit have a depth of less than about four inches.

18. The sub-woofer speaker system of claim 17 wherein said sub-woofer audio driver has a depth of less than about four inches.

* * * * *